US010082095B2

(12) United States Patent
Han

(10) Patent No.: US 10,082,095 B2
(45) Date of Patent: Sep. 25, 2018

(54) DEVICE FOR CONTROLLING DRIVING MODE AND METHOD FOR CONTROLLING DRIVING MODE USING THE SAME

(71) Applicant: Hyundai Motor Company, Seoul (KR)

(72) Inventor: Kyoungchan Han, Gunpo-si (KR)

(73) Assignee: Hyundai Motor Company, Seoul (KR)

( * ) Notice: Subject to any disclaimer, the term of this patent is extended or adjusted under 35 U.S.C. 154(b) by 34 days.

(21) Appl. No.: 15/265,658

(22) Filed: Sep. 14, 2016

(65) Prior Publication Data

US 2017/0122236 A1 May 4, 2017

(30) Foreign Application Priority Data

Nov. 3, 2015 (KR) ..... 10-2015-0153717

(51) Int. Cl.

| | |
|---|---|
| ***F02D 41/00*** | (2006.01) |
| ***F02D 41/26*** | (2006.01) |
| ***F02D 17/02*** | (2006.01) |
| *F02M 26/05* | (2016.01) |

(52) U.S. Cl.

CPC ..... *F02D 41/0087* (2013.01); *F02D 17/02* (2013.01); *F02D 41/26* (2013.01); *F02D 2200/023* (2013.01); *F02D 2200/024* (2013.01); *F02D 2200/0614* (2013.01); *F02D 2200/101* (2013.01); *F02D 2200/703* (2013.01); *F02M 26/05* (2016.02)

(58) Field of Classification Search

CPC ..... F02D 41/00; F02D 41/0087; F02D 41/26; F02D 17/02; F02D 2200/101; F02D 2200/203; F02D 2200/204; F02D 2200/703; F02D 2200/0614

USPC ..... 701/103, 104, 112–115; 123/198 D, 123/198 DB, 198 DC, 198 F

See application file for complete search history.

(56) References Cited

U.S. PATENT DOCUMENTS

| | | | | |
|---|---|---|---|---|
| 6,668,546 | B2 * | 12/2003 | Hayman | F01L 1/02 123/198 F |
| 7,000,602 | B2 * | 2/2006 | Cullen | F02D 41/0082 123/478 |
| 7,025,039 | B2 * | 4/2006 | Bidner | F02P 5/045 123/339.11 |
| 7,086,386 | B2 * | 8/2006 | Doering | F02D 17/02 123/198 F |

(Continued)

FOREIGN PATENT DOCUMENTS

| | | | |
|---|---|---|---|
| JP | 10-018872 | A | 1/1998 |
| JP | 2001-227369 | A | 8/2001 |
| JP | 2015-014281 | A | 1/2015 |

*Primary Examiner* — John Kwon
*Assistant Examiner* — Johnny H Hoang
(74) *Attorney, Agent, or Firm* — Morgan, Lewis & Bockius LLP

(57) ABSTRACT

A method for controlling an operation mode of an engine implementing cylinder deactivation (CDA) by a device for controlling an operation mode, may include determining whether a CDA operation is available by using an operation state signal of a vehicle, determining a fuel consumption prediction value or an exhaust temperature prediction value by the CDA operation when the CDA operation is available: and determining whether to enter a CDA mode by using at least one of the fuel consumption prediction value and the exhaust temperature prediction.

9 Claims, 4 Drawing Sheets

(56) References Cited

U.S. PATENT DOCUMENTS

| | | | | |
|---|---|---|---|---|
| 7,188,468 | B2 * | 3/2007 | Fukusako | F01N 9/005 123/198 F |
| 7,249,583 | B2 * | 7/2007 | Bidner | F01L 13/00 123/198 DB |
| 7,360,356 | B2 * | 4/2008 | Narita | F01N 3/0821 123/198 F |
| 2013/0184949 | A1 * | 7/2013 | Saito | B60W 10/11 701/58 |
| 2014/0053804 | A1 * | 2/2014 | Rayl | F02D 41/0087 123/350 |
| 2015/0361907 | A1 * | 12/2015 | Hayman | F02D 41/0087 123/198 F |
| 2016/0146138 | A1 * | 5/2016 | Beikmann | F02D 41/0087 701/54 |

* cited by examiner

DEVICE FOR CONTROLLING DRIVING MODE AND METHOD FOR CONTROLLING DRIVING MODE USING THE SAME

CROSS-REFERENCE TO RELATED APPLICATION

The present application claims priority to and the benefit of Korean Patent Application No. 10-2015-0153717 filed on Nov. 3, 2015, the entire contents of which is incorporated herein for all purposes by this reference.

BACKGROUND OF THE INVENTION

Field of the Invention

The present invention relates to a device for controlling an operation mode and a method for controlling an operation mode using the same.

Description of Related Art

Generally, an automotive engine includes a combustion chamber in which fuel burns to generate power. The combustion chamber is provided with an intake valve for supplying a gas mixture containing the fuel and an exhaust valve for expelling the burned gas. The intake and exhaust valves open and close the combustion chamber by a valve lift apparatus connected to a crankshaft.

Recently, a cylinder deactivation apparatus of a vehicle for realizing the cylinder deactivation function has been under investigation.

A diesel vehicle includes an exhaust gas post-treatment system in order to purify exhaust gas discharged from an engine. A post-processing system mounted for the purpose of reducing exhaust gas includes an exhaust gas post-treatment apparatus such as a DOC (diesel oxidation catalyst), a DPF (diesel particulate matter filter), an LNT (lean NOx trap), and an SCR (selective catalyst reduction) device, and requires a basic temperature for chemical reaction.

However, when a temperature of the exhaust gas is low, the purification performance of the exhaust gas is deteriorated until the catalyst is activated, so there is a difficulty that the fuel is additionally injected so as to raise the temperature of the catalyst.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a device for controlling an operation mode and a method for controlling an operation mode using the same having advantages of controlling an operation mode of an engine that can implement cylinder deactivation (CDA).

An exemplary embodiment of the present invention provides a method for controlling an operation mode of an engine that can implement cylinder deactivation (CDA) by a device for controlling an operation mode, the method including: determining whether a CDA operation is available by using an operation state signal of a vehicle; calculating a fuel consumption prediction value or an exhaust temperature prediction value by the CDA operation if the CDA operation is available: and determining whether to enter a CDA mode by using at least one of the fuel consumption prediction value and the exhaust temperature prediction.

The operation state signal of the vehicle may include at least one selected from the group including an engine speed, a fuel amount, an atmospheric pressure, an atmospheric temperature, a coolant temperature, an oil pressure, and an oil temperature.

The calculating may include calculating a first fuel consumption prediction value in a normal mode and a second fuel consumption prediction value in a CDA mode.

The calculating may further include predicting a fuel consumption duration time when the second fuel consumption prediction value in the CDA mode is greater than the first fuel consumption prediction value in the normal mode.

The determining whether to enter the CDA mode may include determining to enter the CDA mode when the fuel consumption duration time is equal to or greater than a threshold value.

The calculating may include calculating a first exhaust temperature prediction value in a normal mode and a second exhaust temperature prediction value in a CDA mode.

The calculating may further include predicting an exhaust temperature increasing duration time when the second exhaust temperature prediction value in the CDA mode is greater than the first exhaust temperature prediction value in the normal mode.

The determining whether to enter the CDA mode may include determining to enter the CDA mode when the exhaust temperature increasing duration time is equal to or greater than a threshold value.

An exemplary embodiment of the present invention provides a device for controlling an operation mode, including: a calculation unit configured to calculate a fuel consumption prediction value by a cylinder deactivation (CDA) operation; and a controller configured to determine whether the CDA operation is available, and determine whether or not to enter a CDA mode.

The calculation unit may include a fuel consumption calculation unit configured to calculate a first fuel consumption prediction value in a normal mode and a second fuel consumption prediction value in a CDA mode.

The calculation unit may further include a fuel consumption duration time calculation unit configured to calculate a fuel consumption duration time when the second fuel consumption prediction value is greater than the first fuel consumption prediction value.

The controller may determine to enter the CDA mode when the fuel consumption duration time is equal to or greater than a threshold value.

The calculation unit may further include an exhaust temperature calculation unit configured to calculate an exhaust temperature prediction value by the CDA operation, and calculate a first exhaust temperature prediction value in the normal mode and a second exhaust temperature prediction value in the CDA mode.

The calculation unit may further include an exhaust temperature duration time calculation unit configured to calculate an exhaust temperature increasing duration time such that the second exhaust temperature prediction value is greater than the first exhaust temperature prediction value.

The controller may determine to enter the CDA mode when the exhaust temperature increasing duration time is equal to or greater than a threshold value.

According to the present invention for achieving the object, by determining to enter the CDA mode in consideration of the fuel consumption by CDA operation in the diesel engine, it is possible to expand an operation region of the CDA mode and improve the fuel consumption.

In addition, according to the present invention for achieving the object, determining to enter the CDA mode in consideration of the exhaust temperature, it is possible to reduce a cost by shortening an activation temperature reaching time of the catalyst, and improve the fuel consumption by reducing an injected amount of the fuel for the increasing of the catalyst temperature.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
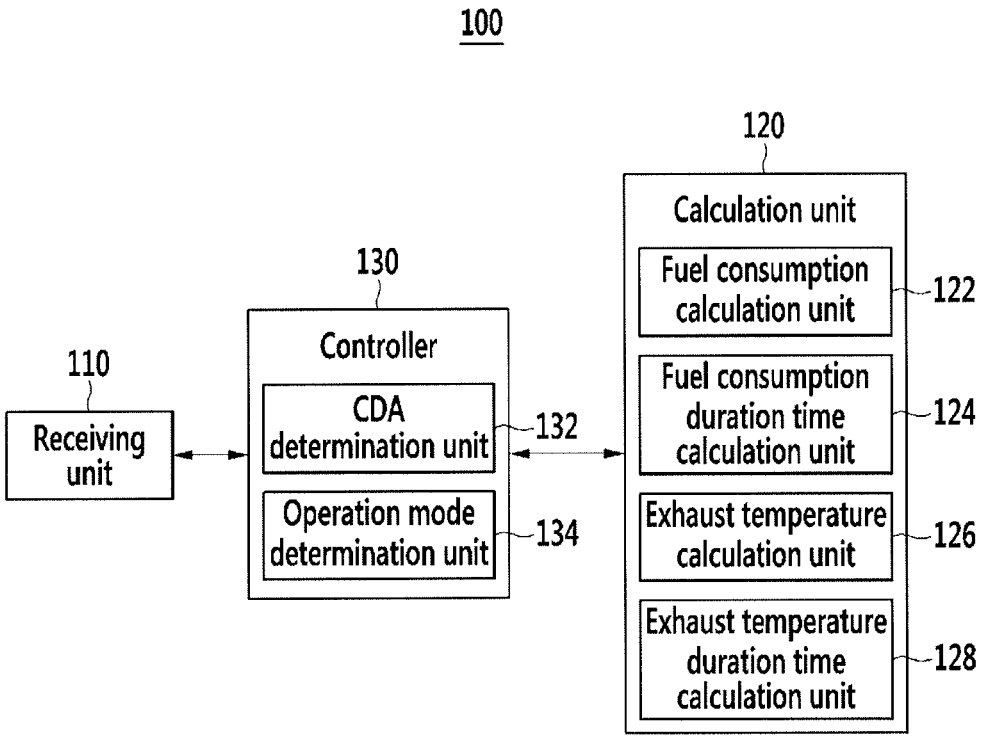
FIG. 1 is a schematic diagram of a device for controlling an operation mode according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration. As those skilled in the art would realize, the described embodiments may be modified in various different ways, all without departing from the spirit or scope of the present invention.

Throughout the specification, unless explicitly described to the contrary, the word "comprise" and variations such as "comprises" or "comprising" will be understood to imply the inclusion of stated elements but not the exclusion of any other elements.

Parts indicated by like reference numerals are the same components throughout the specification.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles, and other alternative fuel vehicles (e.g., fuel derived from resources other than petroleum).

In addition, some methods may be executed by at least one controller. The term "controller" refers to a hardware device including a memory and a processor configured to execute one or more steps interpreted as an algorithm structure. The memory stores algorithm steps, and the processor specifically executes the algorithm steps to perform one or more processes to be described below.

Further, control logic of the present invention may be implemented by a non-transient computer-readable medium on a computer-readable device including executable program instructions executed by a processor, a controller, or the like. Examples of a computer-readable medium, although not restrictive, include ROMs, RAMs, CD-ROMs, magnetic tapes, floppy disks, flash drives, smart cards, and optical data storages. The computer-readable recording medium may be distributed in a network-connected computer system, and for example, may be stored and executed in a distributed manner by a telematics server or Controller Area Network (CAN).

A device for controlling an operation mode and a method for controlling an operation mode using the same will now be described with reference to FIG. 1 to FIG. 4.

FIG. 1 is a schematic diagram of a device for controlling an operation mode according to an exemplary embodiment of the present invention. In this case, for convenience of explanation, a configuration of the device for controlling an operation mode according to the exemplary embodiment of the present invention is schematically illustrated, but the device for controlling an operation mode is not limited thereto.

Referring to FIG. 1, the device for controlling an operation mode 100 according to an exemplary embodiment of the present invention includes a receiving unit 110, a calculation unit 120, and a controller 130.

The receiving unit 110 receives a temperature of an exhaust gas of an engine or a temperature of a catalyst, and transmits received temperature values to the controller 130. The receiving unit 110 can receive a temperature T1 at the rear of a turbocharger, a temperature T2 at the rear of an LNT, and a temperature T3 at the rear of a DPF.

The calculation unit 120 calculates a fuel consumption prediction value when an engine is operated in a normal mode and a fuel consumption prediction value when the engine is operated in a cylinder deactivation (CDA) mode. In addition, the calculation unit 120 calculates an exhaust gas temperature prediction value in the normal mode and an exhaust gas temperature prediction value in the CDA mode.

The calculation unit 120 includes a fuel consumption calculation unit 122, a fuel consumption duration time calculation unit 124, an exhaust temperature calculation unit 126, and an exhaust temperature duration time calculation unit 128 according to an exemplary embodiment of the present invention.

The fuel consumption calculation unit 122 calculates the fuel consumption prediction value in a normal mode, and calculates the fuel consumption prediction value in the CDA mode.

The fuel consumption duration time calculation unit 124 calculates a consumption duration time when the fuel consumption prediction value in the CDA mode is greater than the fuel consumption prediction value in the normal mode. Herein, the fuel consumption duration time includes a prediction time when the fuel consumption prediction value in the CDA mode is maintained to be greater than the fuel consumption prediction value in the normal mode when entering the CDA mode.

The exhaust temperature calculation unit 126 calculates the exhaust temperature prediction value in the normal mode and the exhaust temperature prediction value in the CDA mode.

The exhaust temperature duration time calculation unit 128 calculates an exhaust temperature increasing duration time in which the exhaust temperature prediction value in the CDA mode is greater than the exhaust temperature prediction value in the normal mode. Herein, the exhaust temperature increasing duration time includes a prediction time in which the exhaust temperature prediction value in the CDA mode is maintained to be greater than the exhaust temperature prediction value in the normal mode when entering the CDA mode.

The controller 130 determines whether to enter the CDA mode by using at least one selected from the group including the fuel consumption prediction value, the fuel consumption duration time, the exhaust temperature prediction value, and the exhaust temperature increasing duration time.

The controller 130 determines to enter the CDA mode when the fuel consumption duration time is equal to or greater than a predetermined threshold value. Further, the controller 130 can determine to enter the CDA mode when the exhaust temperature increasing duration time is equal to or greater than a predetermined threshold value.

The controller 130 includes a CDA determination unit 132 and an operation mode determination unit 134 according to an exemplary embodiment of the present invention.

The CDA determination unit 132 determines whether the CDA operation is available by using an operation state signal of the vehicle. Herein, the operation state signal of the vehicle includes at least one selected from the group including an engine speed, a fuel amount, an atmospheric pressure, an atmospheric temperature, a coolant temperature, an oil pressure, and an oil temperature.

The operation mode determination unit 134 determines whether to enter the CDA mode by using at least one of the fuel consumption prediction value and the exhaust temperature prediction value.

For such an object, the controller 130 may be implemented with at least one processor operating by a predetermined program, and the predetermined program may be programmed to perform each step according to a method for controlling the operation mode according to an exemplary embodiment of the present invention.

Figure 2:
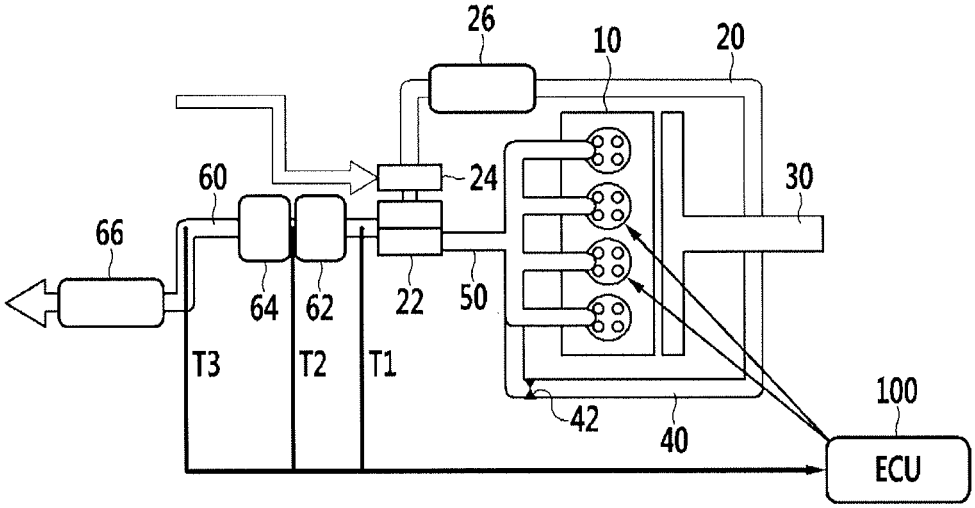
FIG. 2 is a schematic diagram of a diesel engine to implement a CDA operation according to an exemplary embodiment of the present invention.

FIG. 2 is a schematic diagram of a diesel engine to implement a CDA operation according to an exemplary embodiment of the present invention. In this case, for convenience of explanation, a configuration of the device for learning an engine clutch contact point of a hybrid vehicle according to the exemplary embodiment of the present invention is schematically illustrated, but the diesel engine is not limited thereto.

As shown in FIG. 2, the vehicle that can implement the CDA operation according to an exemplary embodiment of the present invention includes an engine 10, an intake pipe 20, a turbine 22, a compressor 24, an intercooler 26, an intake manifold 30, an EGR pipe 40, an exhaust manifold 50, and an exhaust pipe 60.

The compressor 24 takes in air, and the air is supplied to the intercooler 26. The air is cooled in the intercooler 26 and supplied to the engine 10 via the intake pipe 20 and the intake manifold 30. The turbine 22 is connected to the exhaust pipe 60 exhausting an exhaust gas of the exhaust manifold 50. An Exhaust Gas Recirculation (EGR) valve 42 is installed at a center of the EGR pipe 40 connecting the exhaust manifold 50 and the intake manifold 30.

An exhaust gas post-treatment system of the diesel vehicle includes a diesel oxidation catalyst (DOC) or a lean NOx trap (LNT) 62, a diesel particulate filter (DPF) 64, and a selective catalyst reduction (SCR) device 66 in order to reduce pollutants such as carbon monoxide, hydrocarbons, particulate matters, and nitrogen oxides that are included in exhaust gas.

Herein, the device for controlling an operation mode 100 according to an exemplary embodiment of the present invention determines the operation mode of the engine 10 by using the fuel consumption and the exhaust gas temperature increase. The device for controlling an operation mode 100 measures the temperature T1 at the rear of the turbine 22, the temperature T2 at the rear of the LNT 62, and the temperature T3 at the rear of the DPF 64, and determines whether to enter the CDA mode by using the measured temperatures.

Referring to the description, the device for controlling an operation mode 100 may be implemented by an engine control unit (ECU) according to an exemplary embodiment of the present invention, and the operation of the ECU and so on are obvious to a skilled person in the art, so a detailed explanation thereof will be omitted.

Figure 3:
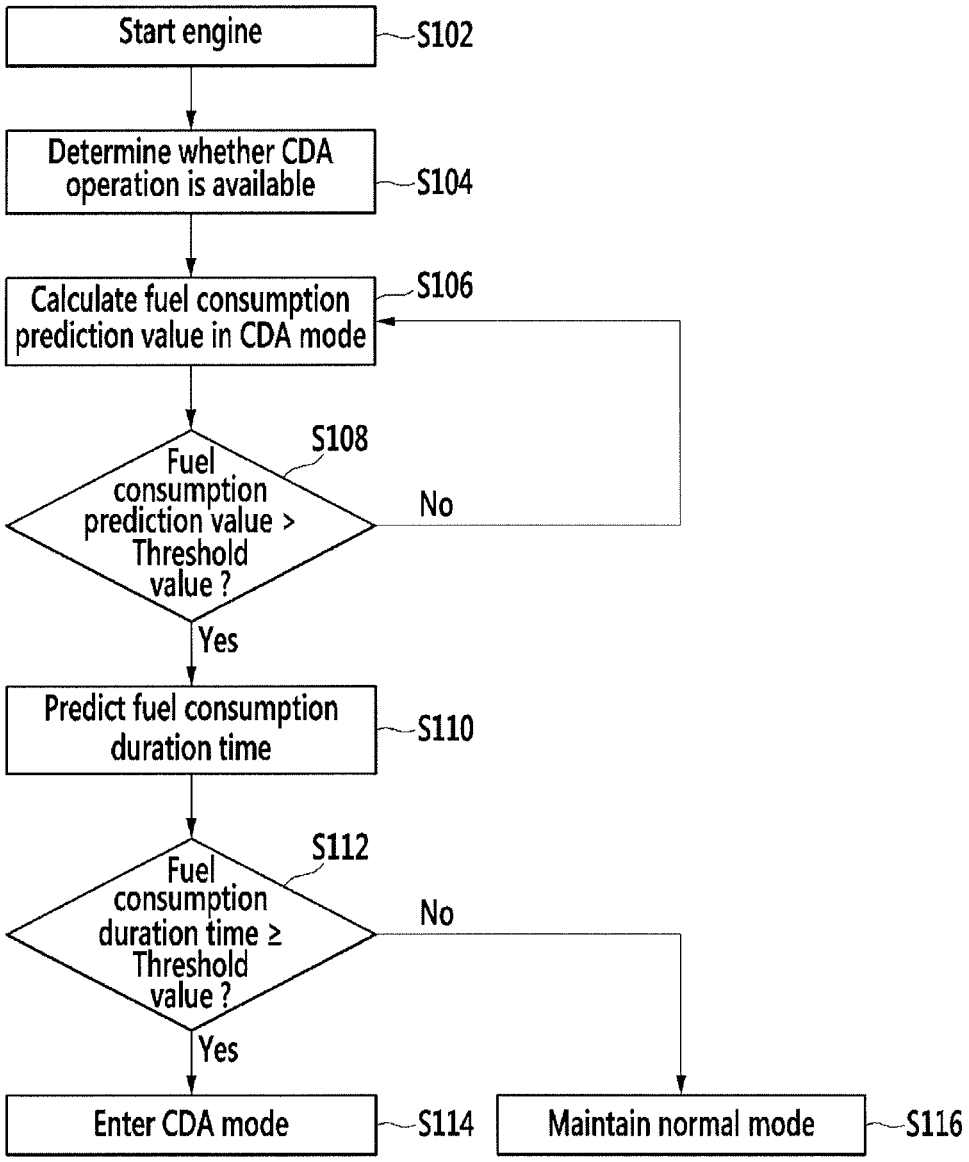
FIG. 3 is a flowchart briefly showing a process for determining to enter a CDA mode by predicting fuel consumption according to an exemplary embodiment of the present invention.

FIG. 3 is a flowchart briefly showing a process for determining to enter a CDA mode by predicting fuel consumption according to an exemplary embodiment of the present invention. The flowchart will be described with the same reference numerals as those of the configuration of FIG. 1 and FIG. 2.

Referring to FIG. 3, when the engine starts, the device for controlling an operation mode 100 according to an exemplary embodiment of the present invention determines whether the CDA operation is available by using the operation state signal of the vehicle at steps S102 and S104.

If the CDA operation is available, the device for controlling an operation mode 100 calculates the fuel consumption prediction value in the CDA mode at step S106. Herein, the fuel consumption prediction value includes a value of the fuel consumption prediction value of the CDA mode divided by the fuel consumption prediction value of the normal mode.

The device for controlling an operation mode 100 predicts the fuel consumption duration time when the fuel consumption prediction value is equal to or greater than a predetermined threshold value at steps S108 and S110. Herein, the fuel consumption duration time includes a prediction time when the fuel consumption prediction value in the CDA mode is maintained to be greater than the fuel consumption prediction value in the normal mode when entering the CDA mode. The device for controlling an operation mode 100 calculates the time to keep an enhancement of the fuel consumption in the CDA mode.

In this case, the device for controlling an operation mode 100 calculates an operation point of the engine changed to the CDA mode by using a rotation speed change rate and a load change rate of the engine. The device for controlling an operation mode 100 can predict the fuel consumption duration time by using the operation point of the engine changed to the CDA and the operation point of the engine maintaining the enhancement of the fuel consumption.

When the time of the enhancement of the fuel consumption in the CDA mode is short or the mode is frequently converted, durability is deteriorated and engine control problems occur. Therefore, the device for controlling an operation mode 100 controls to convert to the CDA mode when the time of the enhancement of the fuel consumption is maintained for a predetermined time.

The device for controlling an operation mode 100 according to an exemplary embodiment of the present invention determines the operation mode of the engine 10 by comparing the fuel consumption duration time with the predetermined threshold value at step S112.

The device for controlling an operation mode 100 controls to enter the CDA mode when the fuel consumption duration time is equal to or greater than the predetermined threshold value, and controls to maintain the normal mode when the fuel consumption duration time is lower than the predetermined threshold value at the steps S114 and S116.

Figure 4:
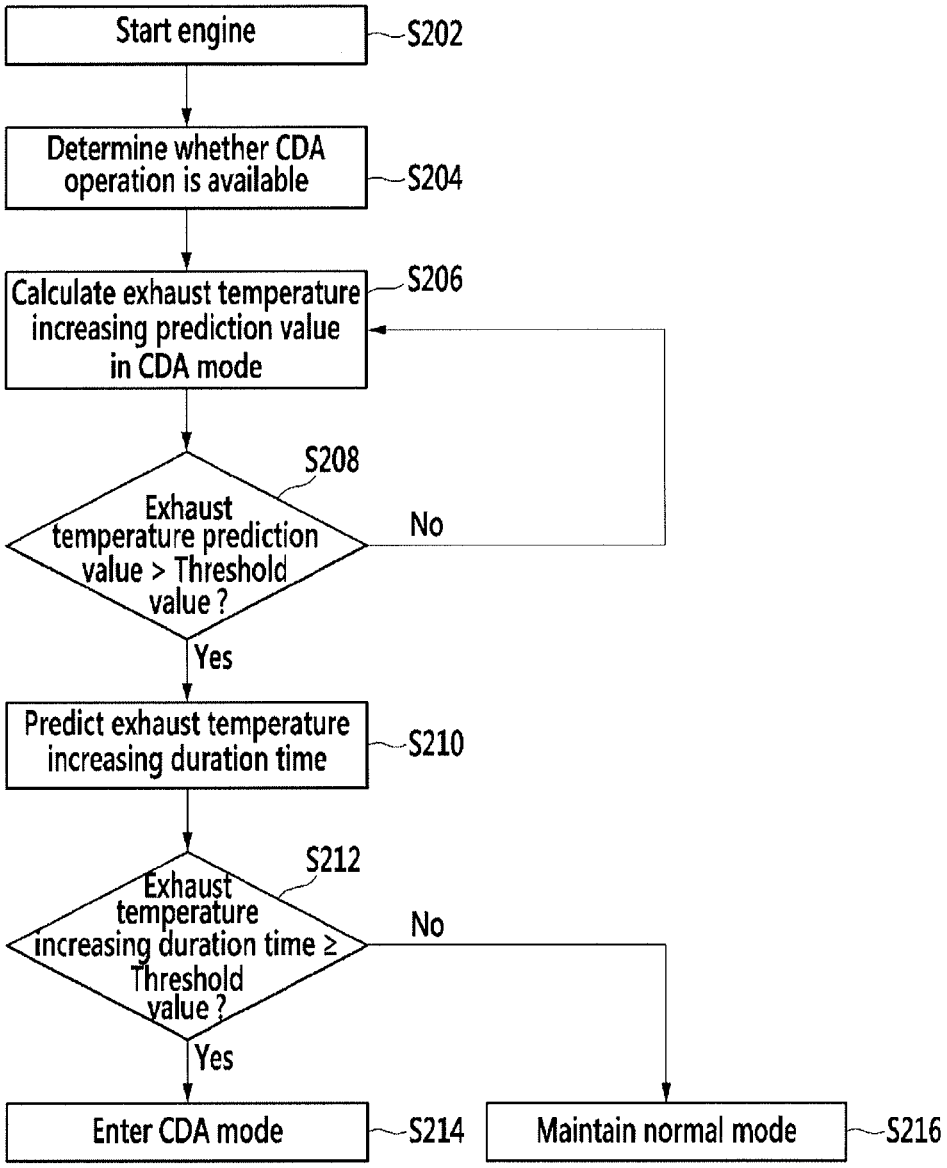
FIG. 4 is a flowchart briefly showing a process for determining to enter a CDA mode by predicting an exhaust temperature increasing effect according to an exemplary embodiment of the present invention.

FIG. 4 is a flowchart briefly showing a process for determining to enter a CDA mode by predicting an exhaust temperature increasing effect according to an exemplary embodiment of the present invention. The flowchart will be described with the same reference numerals as those of the configuration of FIG. 1 and FIG. 2.

Referring to FIG. 4, when the engine starts, the device for controlling an operation mode 100 according to an exemplary embodiment of the present invention determines whether the CDA operation is available by using the operation state signal of the vehicle at steps S202 and S204.

If the CDA operation is available, the device for controlling an operation mode 100 calculates the exhaust temperature increasing prediction value in the CDA mode at step S206. Herein, the exhaust temperature prediction value includes a value of the exhaust temperature prediction value of the CDA mode divided by the exhaust temperature prediction value of the normal mode. The exhaust temperature increasing prediction value represents a degree of the increasing of the exhaust gas temperature by the CDA operation.

The device for controlling an operation mode 100 predicts the exhaust temperature increasing duration time when the exhaust temperature prediction value is equal to or greater than the predetermined threshold value at steps S208 and S210. Herein, the exhaust temperature increasing duration time includes a prediction time in which the exhaust temperature prediction value in the CDA mode is maintained to be greater than the exhaust temperature prediction value in the normal mode.

The device for controlling an operation mode 100 according to an exemplary embodiment of the present invention determines the operation mode of the engine 10 by comparing the exhaust temperature increasing duration time with the predetermined threshold value at step S212.

The device for controlling an operation mode 100 controls to enter the CDA mode when the exhaust temperature increasing duration time is equal to or greater than the predetermined threshold value, and controls to maintain the normal mode when the exhaust temperature increasing duration time is lower than the predetermined threshold value at the steps S214 and S216.

As described, the device and method for controlling an operation mode according to an exemplary embodiment of the present invention determines to enter the CDA mode in consideration of the fuel consumption by CDA operation in the diesel engine. Therefore, it is possible to expand an operation region of the CDA mode and improve the fuel consumption.

In addition, the device and method for controlling an operation mode according to an exemplary embodiment of the present invention determines to enter the CDA mode in consideration of the exhaust temperature. Therefore, it is possible to reduce a cost by shortening an activation temperature reaching time of the catalyst, and improve the fuel consumption by reducing an injected amount of the fuel for the increasing of the catalyst temperature.

The foregoing exemplary embodiments of the present invention are not implemented only by an apparatus and a method, and therefore may be realized by programs realizing functions corresponding to the configuration of the exemplary embodiment of the present invention or recording media on which the programs are recorded.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "interior", "exterior", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method for controlling an operation mode of engine implementing a cylinder deactivation (CDA) by a controller, the method comprising:

determining an operation state signal of engine;

determining whether a CDA operation is available by using the operation state signal, calculating a fuel consumption prediction value and an exhaust temperature prediction value in the CDA operation when the CDA operation is available; and determining an engine operation whether to enter a CDA mode by using at least one of the fuel consumption prediction value and the exhaust temperature prediction value, wherein the calculating the fuel consumption prediction value includes:

determining a first fuel consumption prediction value in a normal mode and a second fuel consumption prediction value in the CDA mode, and predicting a fuel consumption duration time when the second fuel consumption prediction value in the CDA mode is greater than the first fuel consumption prediction value in the normal mode, wherein the determining the engine operation whether to enter the CDA mode includes determining to enter the CDA mode when the fuel consumption duration time is equal to or greater than a threshold value.

2. The method of claim 1, wherein the operation state signal of the vehicle includes at least one of an engine speed, a fuel amount, an atmospheric pressure, an atmospheric temperature, a coolant temperature, an oil pressure, and an oil temperature.

3. The method of claim 2, wherein the determining the exhaust temperature prediction value includes:

determining a first exhaust temperature prediction value in the normal mode and a second exhaust temperature prediction value in the CDA mode.

4. The method of claim 3, wherein the determining the exhaust temperature prediction value further includes:

predicting an exhaust temperature increasing duration time when the second exhaust temperature prediction value in the CDA mode is greater than the first exhaust temperature prediction value in the normal mode.

5. The method of claim 4, wherein the determining whether to enter the CDA mode includes:

determining to enter the CDA mode when the exhaust temperature increasing duration time is equal to or greater than a threshold value.

6. A device for controlling an operation mode of engine, comprising:

a calculation unit configured to calculate a fuel consumption prediction value in a cylinder deactivation (CDA) operation of the engine, and a controller configured to determine whether the CDA operation is available, and to determine an engine operation whether or not entering a CDA mode, wherein the calculation unit includes:

a fuel consumption calculation unit configured to determine a first fuel consumption prediction value in a normal mode and a second fuel consumption prediction value in the CDA mode; and a fuel consumption duration time calculation unit configured to determine a fuel consumption duration time when the second fuel consumption prediction value is greater than the first fuel consumption prediction value, and wherein the controller determines to enter the CDA mode when the fuel consumption duration time is equal to or greater than a threshold value.

7. The device of claim 6, wherein the calculation unit further includes:

an exhaust temperature calculation unit configured to determine an exhaust temperature prediction value by the CDA operation, and determine a first exhaust temperature prediction value in the normal mode and a second exhaust temperature prediction value in the CDA mode.

8. The device of claim 7, wherein the calculation unit further includes:

an exhaust temperature duration time calculation unit configured to determine an exhaust temperature increasing duration time when the second exhaust temperature prediction value is greater than the first exhaust temperature prediction value.

9. The device of claim 8, wherein the controller determines to enter the CDA mode when the exhaust temperature increasing duration time is equal to or greater than a threshold value.

* * * * *